US006974359B2

(12) United States Patent
Pothoven et al.

(10) Patent No.: US 6,974,359 B2
(45) Date of Patent: Dec. 13, 2005

(54) VISUAL DISPLAY

(75) Inventors: Floyd R. Pothoven, Bellflower, CA (US); Anthony J. Cooper, Murietta, CA (US)

(73) Assignee: Ceravision Technology Limited, Dublin (IE)

( * ) Notice: Subject to any disclaimer, the term of this patent is extended or adjusted under 35 U.S.C. 154(b) by 113 days.

(21) Appl. No.: 10/181,643

(22) PCT Filed: Jan. 18, 2001

(86) PCT No.: PCT/US01/02956

§ 371 (c)(1),
(2), (4) Date: Mar. 17, 2003

(87) PCT Pub. No.: WO01/54158

PCT Pub. Date: Jul. 26, 2001

(65) Prior Publication Data

US 2004/0124760 A1 Jul. 1, 2004

Related U.S. Application Data

(60) Provisional application No. 60/177,516, filed on Jan. 21, 2000.

(51) Int. Cl.[7] ..... H01J 9/00
(52) U.S. Cl. ..... 445/24; 445/25
(58) Field of Search ..... 445/24, 25, 50, 445/51

(56) References Cited

U.S. PATENT DOCUMENTS 3,755,704 A 8/1973 Spindt et al.
4,029,371 A 6/1977 Kupsky
4,407,658 A 10/1983 Bernot et al.
4,449,949 A 5/1984 Eto et al.

FOREIGN PATENT DOCUMENTS

| | | |
|---|---|---|
| EP | 0523318 | 1/1993 |
| FR | 2704672 | 2/1997 |
| WO | 9859357 | 12/1998 |
| WO | 9917329 | 4/1999 |
| WO | 9917330 | 4/1999 |
| WO | 0033345 | 6/2000 |

*Primary Examiner*—Joseph Williams
(74) *Attorney, Agent, or Firm*—Alfred A. Fressola; Ware, Fressola, Van Der Sluys & Adolphson

(57) ABSTRACT

A visual has a multilayer ceramic substrate (1) with an emission layer (2) on its front face. The substrate is mounted on carrier (4) with a L-shaped cross-section, via the foot (41) of the L. A glass face plate (5) is on the top of the main limb (42) of the L. The face plate has a phosphor layer (6) on its inside surface. A succession (7) of vias and interconnects in the L provides connection from the substrate (1) to the phosphor layer. A band (8) of frit is screen printed onto the inside of the face plate, peripherally of phosphor layer. In a corresponding position on the top of the main limb, a groove (9) is formed. On assembly of the face plate to the carrier, the frit (8) fits into the groove (9). The face plate abuts the top of the limb (42), thereby defining the separation of the face plate and the emission substrate.

8 Claims, 1 Drawing Sheet

VISUAL DISPLAY

This application claims the benefit of Provisional application Ser. No. 60/177,516, filed Jan. 21, 2000.

FIELD OF THE INVENTION

The present invention relates to a visual display, particularly though not exclusively for use with data processing apparatus.

BACKGROUND OF THE INVENTION

Visual displays for data processing apparatus, such as computers, are normally field emission displays of the cathode ray tube type. These generally have a depth of the order of their size dimension, which conventionally is their corner to corner or diagonal dimension. This depth can render them inconvenient in use. Recently, laptop computers have become increasingly widely used. These incorporate a "flat" screen display, usually of the liquid crystal type.

Proposals have been made to provide displays having flat screen cathode ray tubes. These are known as Spindt cathodes, after the inventor of U.S. Pat. No. 3,755,704. In this specification, they are referred to as field emission devices.

In our International applications Nos WO 99/17329 & -30, our earlier International Applications, we described an improved "flat" screen visual display having a field emission device and in particular an improved method of sealing the display.

Essentially the visual display comprises:

- at least one field emission device including an emission layer on a substrate;
- a glass face plate carrying excitable phosphor material; and
- fused sealing material peripherally sealing the face plate to the emission device(s),
- whereby the face plate is parallelly spaced from the emission layer.

Herein, this visual display is referred to as "the Defined Visual Display".

Essentially the method of sealing the Defined Visual Display consists in the steps of:

- evacuating the display, to evacuate the space between the emission layer and the face plate; and
- irradiating a peripheral region of the face plate to fuse the sealing material, thereby sealingly securing the face plate to the emission device(s).

Herein, this sealing method is referred to as "the Defined Sealing Method".

Object of the Invention

The object of the present invention is to improve "the Defined Sealing Method".

SUMMARY OF THE INVENTION

According to a first aspect of the invention there is provided a method of sealing a Defined Visual Display, the method consisting in the Defined Sealing Method and including the preliminary step of:

- printing the sealing material onto the emission device or the glass face plate.

Preferably the sealing material is screen printed onto the emission device or the face plate.

Where as is preferred, the emission device comprises a carrier attached to a face—the back face—of the substrate opposite from the emission layer, the sealing material is screen printed onto the carrier. Alternatively, where a wall is provided on the front face of the substrate, the sealing material is screen printed onto the wall.

Preferably the sealing material, conveniently glass frit, is screen printed into a recess in a front surface of the carrier, or the wall, whereby the face plate abuts the carrier, or the wall, for controlling the separation of the face plate and the substrate, at least peripherally of the display. Again there is the alternative of screen printing the frit onto a flush surface, conveniently of the face plate, and forming the recess in the front surface of the carrier or the wall, the frit registering in the recess prior to its irradiation.

The recess in the carrier, or wall, can be formed by impression into its material when in the green state, the material preferably being tape cast ceramic. Alternatively, the recess can be cut into the ceramic material after firing, as by laser machining.

In accordance with another preferred feature, where contact pads on the carrier or wall are provided for phosphor line contact ends, conductive paste is deposited on either of the pads or the ends, the conductive paste is fused by irradiation thereof for electrical connection of the pads and lines.

In our earlier International Applications, we described irradiation of a getter for its activation. Thus our preferred sealing method now includes three laser traverses:

1. to seal on the face plate,
2. to connect electrically the face plate,
3. to irradiate the getter.

According to another aspect of the invention there is provided, a Defined Visual Display, the sealing material being printed material.

Preferably, the sealing material is screen printed frit.

Preferably, the substrate is attached at its back face to a carrier, the carrier being sealed to the face plate. Alternatively, the substrate is attached at its front face to a wall, which is sealed to the face plate.

In either alternative, the carrier or the wall preferably has a slot for captivating a getter. The portion of the wall set inwards from the slot forming a screen for retaining sputter from activation of the getter from contaminating the emission layer.

BRIEF DESCRIPTION OF THE DRAWING

To help understanding of the invention, two specific embodiments thereof will now be described by way of example and with reference to the accompanying drawings, in which.

BEST MODE FOR CARRYING OUT THE INVENTION

Figure 1:
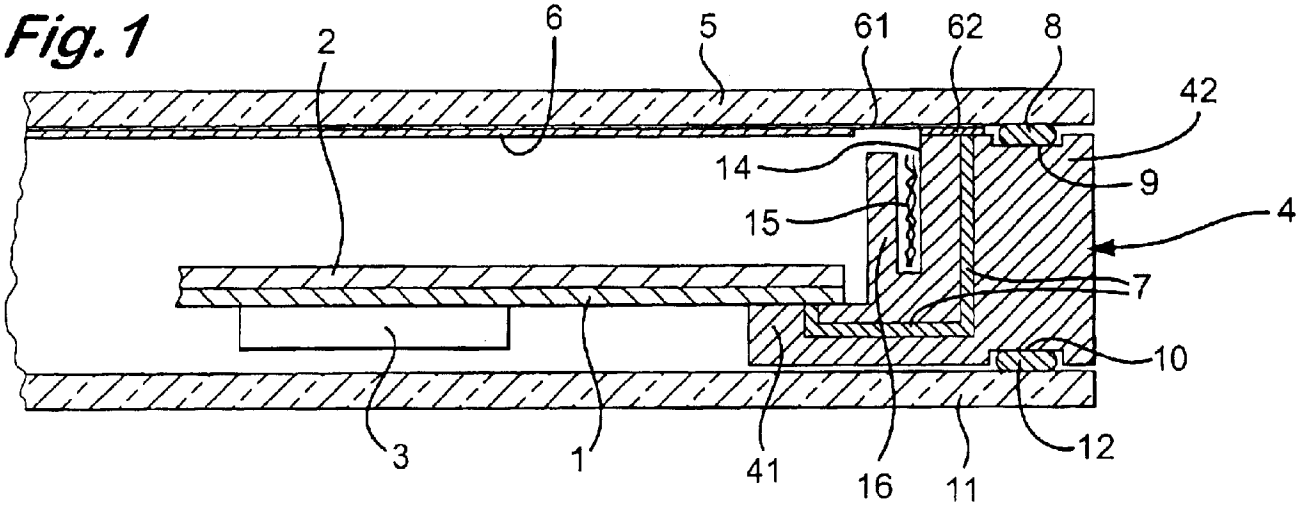
FIG. 1 is a cross-sectional view of a representational edge portion of a visual display according to the invention and FIG. 2 is a similar view of another visual display according to the invention.

The visual display of FIG. 1 is generally rectangular and has a similar construction along each edge. Thus the section shown in FIG. 1 is representative of the whole.

The display has a multilayer ceramic substrate 1 with an emission layer 2 on its front face. Drivers 3 are mounted on the back face of the substrate. The substrate is mounted on carrier 4 with a L-shaped cross-section, via the foot 41 of the L. A glass face plate 5 is on the top of the main limb 42 of the L. The face plate has a phosphor layer 6 on its inside surface. A succession 7 of vias and interconnects in the L provides connection from the substrate 1 to the phosphor layer. In these respects, the display is as described in our earlier International Applications.

For the present invention, a band 8 of frit is screen printed onto the inside of the face plate, peripherally of the phosphor layer. In a corresponding position on the top of the main limb 42, a groove 9 is formed. The groove extends around the full extent of the carrier. On assembly of the face plate to the carrier, the screen-printed frit band 8 fits into the groove 9. The face plate abuts the top of the limb 42, thereby defining the separation of the face plate and the emission substrate. (It should be noted that for clarity of the drawing, this abutment is not shown.)

For sealing of the face plate to the emission device, comprised of the substrate and the carrier, the frit is irradiated in vacuum by a laser. This fuses the frit onto both the carrier and the face plate.

The groove 9 is formed in the carrier prior to it firing. The carrier is a laminate of tape cast pieces of ceramic material. After lamination, the groove is pressed into the material whilst still in its green state.

As shown, the carrier has a further groove 10 in its bottom surface. A back closure plate 11, suitably of glass, has screen printed frit 12 provided continuously around it. The back plate is sealed on by irradiation of this frit to fuse into the groove 10. The advantage of this back plate is that it hermetically seals the back of the visual display with the driver chips being enclosed.

Additionally, ends 61 of conductive, indium tin oxide lines in the phosphor layer 6 are provided with screen printed conductive ink spots 62. When the face plate is in position, the spots register with connection pads 71 at the ends of the vias and interconnects 7. After irradiation of the screen printed frit, the spots 62 are irradiated in turn, to fuse them and establish electrical contact between the lines and the vias etc.

Along its inner edge, the main limb of the carrier has a slot 14 for getter material 15. The slot is defined by a strip 16 of the carrier material which leaves a clearance with the face plate for gettering action, and yet is of a height to effectively trap the getter material against its escape and contamination of the emission layer 2 when activated by laser irradiation.

Figure 2:
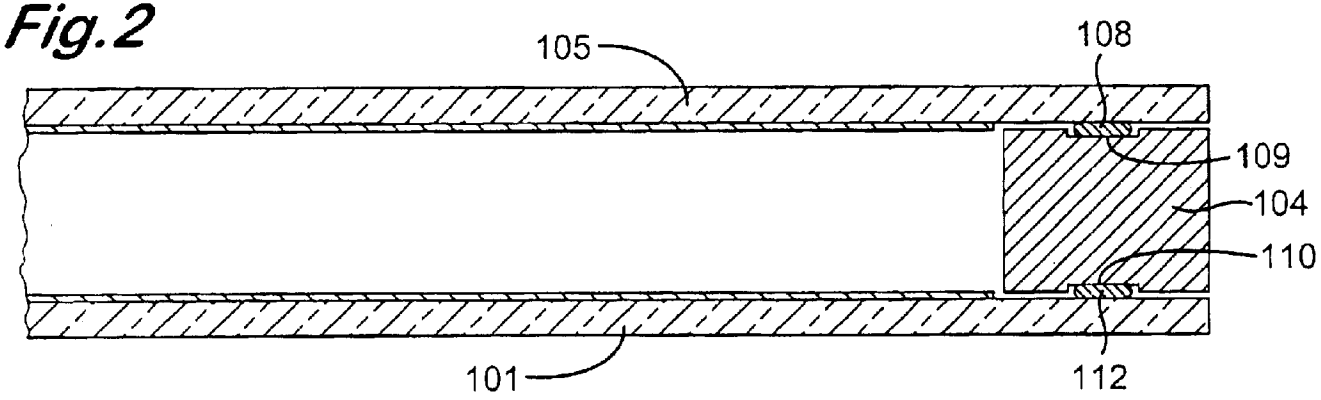

Turning now to FIG. 2 the visual display, there shown in exemplary section similarly to the visual display of FIG. 1, has a glass substrate 101 and a glass face plate 105. Around the edge of these, a ceramic wall 104 is provided. It has upper and lower grooves 109,110 into which frit 108,112 is printed. Once the display has been evacuated, with the components aligned, the frit is irradiated by laser to fuse it to the substrate and the face plate to the wall.

On irradiation, the frit seals the face plate to the wall.

What is claimed is:

1. A method of sealing a Defined Visual Display, the method consisting in the Defined Sealing Method and including the preliminary step of printing the sealing material onto the emission device or the glass face plate of the display, wherein the emission device comprises a carrier attached to a substrate of the emission device and the sealing material is screen printed onto the carrier, wherein the sealing material is screen printed into a recess in a front surface of the carrier, whereby the face plate abuts the carrier, for controlling the separation of the face plate and the substrate, at least peripherally of the display.

2. A method as claimed in claim 1, wherein the emission device comprises a wall attached to a substrate of the emission device and the sealing material is screen printed onto the wall.

3. A method as claimed in claim 1, wherein the sealing material is screen printed onto a flush surface, preferably of the face plate, and forming a recess in the front surface of the carrier, the frit registering in the recess prior to its irradiation.

4. A method as claimed in claim 3, wherein the recess in the carrier is formed by impression into its material when in the green state, the material preferably being tape cast ceramic.

5. A method as claimed in claim 3, wherein the recess in the carrier is cut into the ceramic material after firing, as by laser machining.

6. A method as claimed in claim 1, wherein the sealing material is glass fit.

7. A method as claimed in claim 1, wherein contact pads on the carrier are provided for phosphor line contact ends and conductive paste is deposited on either of the pads or the ends, and the conductive paste is fused by irradiation thereof for electrical connection of the pads and lines.

8. A method as claimed in claim 1, wherein the device includes a getter and the method includes three laser traverses:

to seal on the face plate, to connect electrically the face plate, to irradiate the getter.

* * * * *

UNITED STATES PATENT AND TRADEMARK OFFICE

CERTIFICATE OF CORRECTION

PATENT NO. : 6,974,359 B2
DATED : December 13, 2005
INVENTOR(S) : Pothoven et al.

It is certified that error appears in the above-identified patent and that said Letters Patent is hereby corrected as shown below:

Title page,
Item [57], ABSTRACT,
Line 1, insert -- display -- after "visual".
Line 9, insert -- the -- after "of".

Column 3,
Line 35, delete "71".

Column 4,
Line 36, delete "fit" and insert -- frit --.

Signed and Sealed this

Twenty-eighth Day of March, 2006

JON W. DUDAS
*Director of the United States Patent and Trademark Office*